US010239649B2

(12) United States Patent
Tomioka et al.

(10) Patent No.: US 10,239,649 B2
(45) Date of Patent: Mar. 26, 2019

(54) DOUBLE CONTAINER AND EXTERIOR SLEEVE USED IN DOUBLE CONTAINER

(71) Applicant: Dai Nippon Printing Co., Ltd., Tokyo (JP)

(72) Inventors: Tatsuya Tomioka, Tokyo (JP); Sunao Murata, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 15/548,262

(22) PCT Filed: Feb. 25, 2016

(86) PCT No.: PCT/JP2016/055550
§ 371 (c)(1),
(2) Date: Aug. 2, 2017

(87) PCT Pub. No.: WO2016/136853
PCT Pub. Date: Sep. 1, 2016

(65) Prior Publication Data

US 2018/0016052 A1 Jan. 18, 2018

(30) Foreign Application Priority Data

Feb. 25, 2015 (JP) ..... 2015-034644
Feb. 25, 2015 (JP) ..... 2015-034645

(51) Int. Cl.
*B65D 3/22* (2006.01)
*B65D 3/04* (2006.01)
(Continued)

(52) U.S. Cl.
CPC ..... *B65D 3/22* (2013.01); *B65D 3/04* (2013.01); *B65D 3/28* (2013.01); *B65D 81/38* (2013.01); *B65D 81/3869* (2013.01)

(58) Field of Classification Search
CPC ..... B65D 3/22; B65D 81/3869; B65D 3/04; B65D 3/28; B65D 3/06; B65D 81/3876; B65D 81/3881; B65D 1/265
(Continued)

(56) References Cited

U.S. PATENT DOCUMENTS 5,524,817 A * 6/1996 Meier ..... B65D 3/22 229/4.5
6,193,098 B1 2/2001 Mochizuki et al.
(Continued)

FOREIGN PATENT DOCUMENTS

JP 07-223683 A1 8/1995
JP 08-276927 A1 10/1996
(Continued)

OTHER PUBLICATIONS

Corrected Version of International Search Report and Written Opinion (Application No. PCT/JP2016/055550) dated Jul. 5, 2016 (originally dated May 24, 2016).

*Primary Examiner* — Christopher Demeree
(74) *Attorney, Agent, or Firm* — Burr & Brown, PLLC

(57) ABSTRACT

A double container includes: an inner container having a cylindrical barrel portion the upper circumferential edge of which is formed to have a curled portion, and a bottom portion provided on a lower end of the barrel portion so as to close the lower face thereof; and a exterior sleeve) which covers the barrel portion, and is secured thereto, so as to form a thermal insulating space between itself and the outer side of the barrel portion. The outer surface of the barrel portion of inner container is provided over the entire circumference thereof with a plurality of elongated projections, which consist of thermoplastic resin, arranged in a row and spaced apart in the circumferential direction, the projections
(Continued)

extending in elongated fashion circumferentially and each having an amount of projection of 1.0 to 2.0 mm.

19 Claims, 10 Drawing Sheets

(51) Int. Cl.
*B65D 3/28* (2006.01)
*B65D 81/38* (2006.01)

(58) Field of Classification Search
USPC ..... 229/403, 400, 103.11, 122.32, 4.5; 220/592.17, 592.2, 62.12; 493/106
See application file for complete search history.

(56) References Cited

U.S. PATENT DOCUMENTS

| | | | | |
|---|---|---|---|---|
| 9,758,292 | B2 * | 9/2017 | Leser | B65D 3/14 |
| 9,771,206 | B2 * | 9/2017 | Marshall | B65D 81/3876 |
| 9,783,359 | B2 * | 10/2017 | D'Amato | B65D 81/3874 |
| 9,783,649 | B2 * | 10/2017 | Leser | C08J 9/0023 |
| 2005/0029273 | A1 | 2/2005 | Hechmati | |

FOREIGN PATENT DOCUMENTS

| | | | |
|---|---|---|---|
| JP | 11-321936 | A1 | 11/1999 |
| JP | 3065505 | U | 2/2000 |
| JP | 2001-031152 | A1 | 2/2001 |
| JP | 2008-512319 | A1 | 4/2008 |

* cited by examiner

DOUBLE CONTAINER AND EXTERIOR SLEEVE USED IN DOUBLE CONTAINER

FIELD OF THE INVENTION

This invention relates to a double container and as well as an exterior sleeve used in the double container.

DESCRIPTION OF RELATED ART

In general, a double container is composed of a paper container body having a barrel portion and a bottom portion, and a paper exterior sleeve fitted on the outer side of the container body. A gap is provided between the barrel portion of the container body and the exterior sleeve, the gap affording thermal insulation.

In order to assure the gap between the barrel portion of the container body and the exterior sleeve, the barrel portion of the container body is formed circumferentially with outwardly protruding horizontal ribs according to Patent Document 1. According to Patent Document 2, the outer wall surface of the barrel portion of the container body is provided circumferentially with one to three strip-like projections made of thermoplastic resin. Since the gap between the barrel portion of the container body and the exterior sleeve is assured by horizontal ribs or strip-like projections, heat will not be transferred directly to one's hand even if the hand is holding the container filled with hot water.

PRIOR ART DOCUMENTS

Patent Document 1: Japanese Patent Application Laid-Open No. 11-321936

Patent Document 2: Japanese Patent Application Laid-Open No. 7-223683

According to Patent Document 1, however, the barrel portion per se of the container body is formed to have outwardly directed ribs and there is a possibility, therefore, that an adequate amount of projection (height) cannot be assured. According to Patent Document 2, the outer wall surface of the container body is formed to have strip-like projections, which are made of thermoplastic resin, extending unbroken along the circumferential direction. As a consequence, a comparatively large amount of thermoplastic resin is required.

SUMMARY OF THE INVENTION

An object of the present invention is to provide a double (dual) container in which the amount of thermoplastic resin used can be reduced, while effective thermal insulation is maintained.

Another object of the present invention is to provide a double container intended to conserve resources.

A further object of the present invention is to provide an external sleeve that constitutes the above-mentioned double container.

A double container according to the present invention is characterized by comprising a paper inner container having a cylindrical barrel portion formed to have a curled portion on an upper circumferential edge thereof, and a bottom portion provided on a lower end of the barrel portion so as to close the lower face thereof; and a paper exterior sleeve which covers the barrel portion so as to form a thermal insulating space between itself and the outer surface of the barrel portion; at least one of the outer surface of the barrel portion of the inner container and the inner surface of the exterior sleeve being provided over the entire circumference thereof with a plurality of elongated projections (ribs), which consist of thermoplastic resin, arranged in a row and spaced apart in the circumferential direction, the projections extending in elongated fashion circumferentially and each having an amount of projection of 1.0 to 2.0 mm.

The upper end of the barrel portion is open and hot water or the like is poured into the double container from the upper end. Although the barrel portion generally has the shape of a cylinder the diameter of the upper part of which is slightly larger than that of the lower part, it may just as well have a uniform diameter longitudinally, or it may have the shape of a prism with a polygonal cross-section. The inner surface of the barrel portion and of the bottom portion is provided with a resin film as necessary.

In an embodiment, the exterior sleeve covers substantially the entirety of the barrel portion of the inner container (and will be referred to as a "long exterior sleeve" for the sake of convenience). Specifically, the height of the long exterior sleeve is substantially equal to that of the barrel portion of the inner sleeve. The purport of "substantially the entirety" is that a portion at the upper end and a portion at the lower end of the inner container may just as well have an area not covered by the long exterior sleeve.

In another embodiment, the exterior sleeve has a height smaller than that of the inner container, and the exterior sleeve extends partway from the curled portion of the inner container toward the lower end of the inner container (and will be referred to as a "short exterior sleeve" for the sake of convenience). The plurality of elongated projections are provided on at least one of the outer surface of the barrel portion of the inner container or the inner surface of the short exterior sleeve in an area covered by the short exterior sleeve. The short exterior sleeve has a height that is 40 to 65% that of the inner container, by way of example. In such case the area constituting approximately the upper half of the inner container is covered by the short exterior sleeve. In comparison with the case where use is made of the above-mentioned long exterior sleeve having a height such that the inner container is covered substantially over its full height, the short exterior sleeve enables resources to be conserved. Further, by using the short exterior sleeve, the height of multiple double containers when stacked can be reduced.

According to the present invention, the exterior sleeve is supported from the inner side thereof by the plurality of elongated projections provided in the thermal insulating space between the outer surface of the barrel portion of the inner container and the inner surface of the exterior sleeve. When the double container is grasped by one's hand, the exterior sleeve will not readily contact the barrel portion of the inner container and, as a result, even when hot water or hot coffee or the like is poured into the double container (inner container), the heat from the inner container will not readily be transferred to the exterior sleeve. Thus it is possible for the hand holding the double container to avoid feeling heat.

Further, the plurality of elongated projections are provided in spaced-apart relation (intermittently, non-continuously). In comparison with the case where an elongated projection is provided continuously in the circumferential direction in annular form, therefore, the amount of thermoplastic resin used can be reduced and resources conserved. Furthermore, since there is spacing between mutually adjacent elongated projections, a closed space is not formed by the elongated projections and, as a result, the heat in the inner container will not be confined in the thermal insulating space.

The long exterior sleeve is used upon being secured to the barrel portion of the inner container. The short exterior sleeve may be freely attached to and detached from the inner container or may be secured to the barrel portion of the inner container.

The row of the plurality of elongated projections arranged in a row and spaced apart in the circumferential direction is provided at a position high enough to be easily grasped by one's hand. Preferably, the row of elongated projections is situated on the double container at a location that is above half the height thereof.

Preferably, a material having a paper basis weight (density) smaller than that of the exterior sleeve is used as the barrel portion of the inner container. Thus when the double container is grasped by one's hand, the barrel portion of the inner container can be made to readily yield before the exterior sleeve. It is thus made more difficult for the exterior sleeve to come into contact with the barrel portion of the inner container when the double container is grasped by one's hand.

In an embodiment, spacing between the mutually adjacent elongated projections in the circumferential direction is 5.0 to 15 mm. Even if a point exactly midway between two mutually adjacent and spaced-apart elongated projections is pressed, the exterior sleeve is capable of being supported by the elongated projections on both sides, thereby making it difficult for the exterior sleeve to come into direct contact with the barrel portion of the inner container.

In a preferred embodiment, multiple rows of the plurality of elongated projections arranged in a row and spaced apart in the circumferential direction are provided in spaced-apart relation in the vertical direction. No matter what position in a comparatively large area of the double container along the vertical direction (height direction) thereof the container is grasped, the exterior sleeve can be prevented by the elongated projections from coming into direct contact with the barrel portion.

The spacing between the rows of elongated projections preferably is 25 mm or less. Even if a point exactly midway between two rows of the elongated projections is grasped (pressed), the exterior sleeve is capable of being supported by the elongated projections located above and below.

Preferably, the pluralities of elongated projections included in respective ones of the spaced-apart mutually adjacent rows of elongated projections are provided at positions staggered in such a manner that they do not completely overlap each other in the vertical direction. The exterior sleeve can be supported in good balance by the plurality of elongated projections.

By way of example, each elongated projection is formed to have a length of from 5.0 to 20 mm in the longitudinal direction and a width, which lies in a direction perpendicular to the longitudinal direction, of 1.0 to 2.0 mm.

The present invention provides also an exterior sleeve (short exterior sleeve) constituting the above-described double container. The exterior sleeve according to the present invention covers a barrel portion of a paper inner container having a cylindrical barrel portion formed to have a curled portion on an upper circumferential edge thereof, and a bottom portion provided on a lower end of the barrel portion so as to close the lower face thereof, the exterior sleeve forming a thermal insulating space between itself and the outer surface of the barrel portion, characterized in that the exterior sleeve has a height smaller than that of the inner container and covers the inner container over an area extending partway from curled portion of the inner container toward the lower circumferential edge of the inner container; the inner surface of the exterior sleeve being provided over the entire circumference thereof with a plurality of elongated projections, which consist of thermoplastic resin, arranged in a row and spaced apart in the circumferential direction, the projections extending in elongated fashion circumferentially and each having an amount of projection of 1.0 to 2.0 mm.

By inserting the inner container from its bottom portion into the exterior sleeve, the outer side of the inner container is covered by the exterior sleeve. The area extending partway from the curled portion of the inner container toward the lower circumferential edge of the inner container is double-walled, whereby a thermal insulating space is formed. The exterior sleeve is supported from its inner side by the plurality of elongated projections provided on the inner surface of the exterior sleeve. When the double container is grasped by one's hand, the exterior sleeve will not readily contact the barrel portion of the inner container and, as a result, even when hot water or hot coffee or the like is poured into the double container (inner container), the heat from the inner container will not readily be transferred to the exterior sleeve. Thus it is possible for the hand holding the double container to avoid feeling heat. Further, the plurality of elongated projections are provided in spaced-apart relation (intermittently, non-continuously). In comparison with the case where an elongated projection is provided continuously in the circumferential direction in annular form, therefore, the amount of thermoplastic resin used can be reduced and resources conserved. Furthermore, since there is spacing between mutually adjacent elongated projections, a closed space is not formed by the elongated projections and, as a result, the heat in the inner container will not be confined in the thermal insulating space.

In a case where a substance at high temperature such as hot water or hot coffee is poured into the inner container, the inner container is covered by the exterior sleeve of according to the present invention. Since the exterior sleeve according to the present invention can be used any number of times, greater conservation of resources can be achieved.

DETAILED DESCRIPTION OF THE INVENTION

Figure 1:
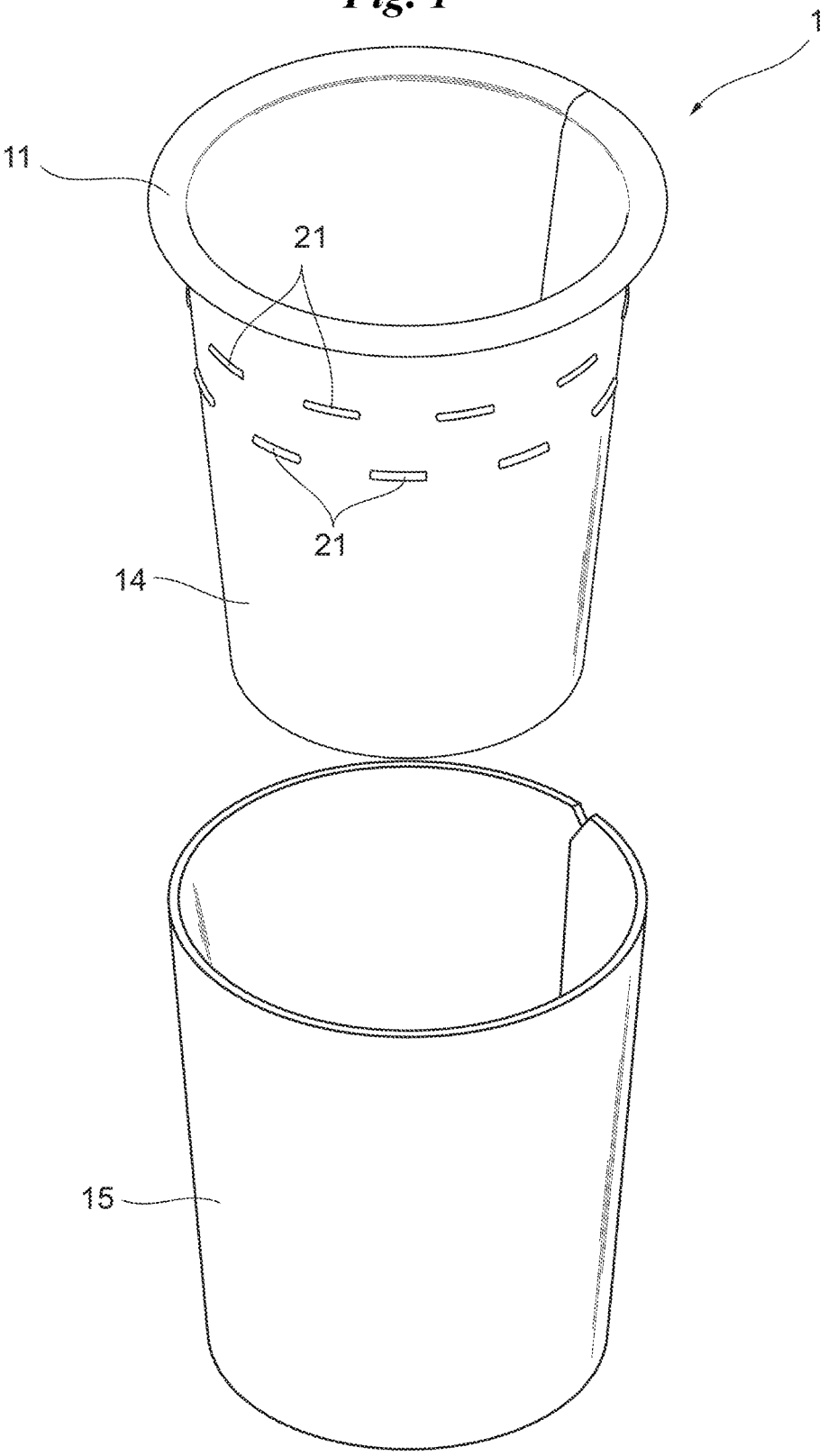
FIG. 1 is an exploded perspective view of a double container according to a first embodiment.
Figure 2:
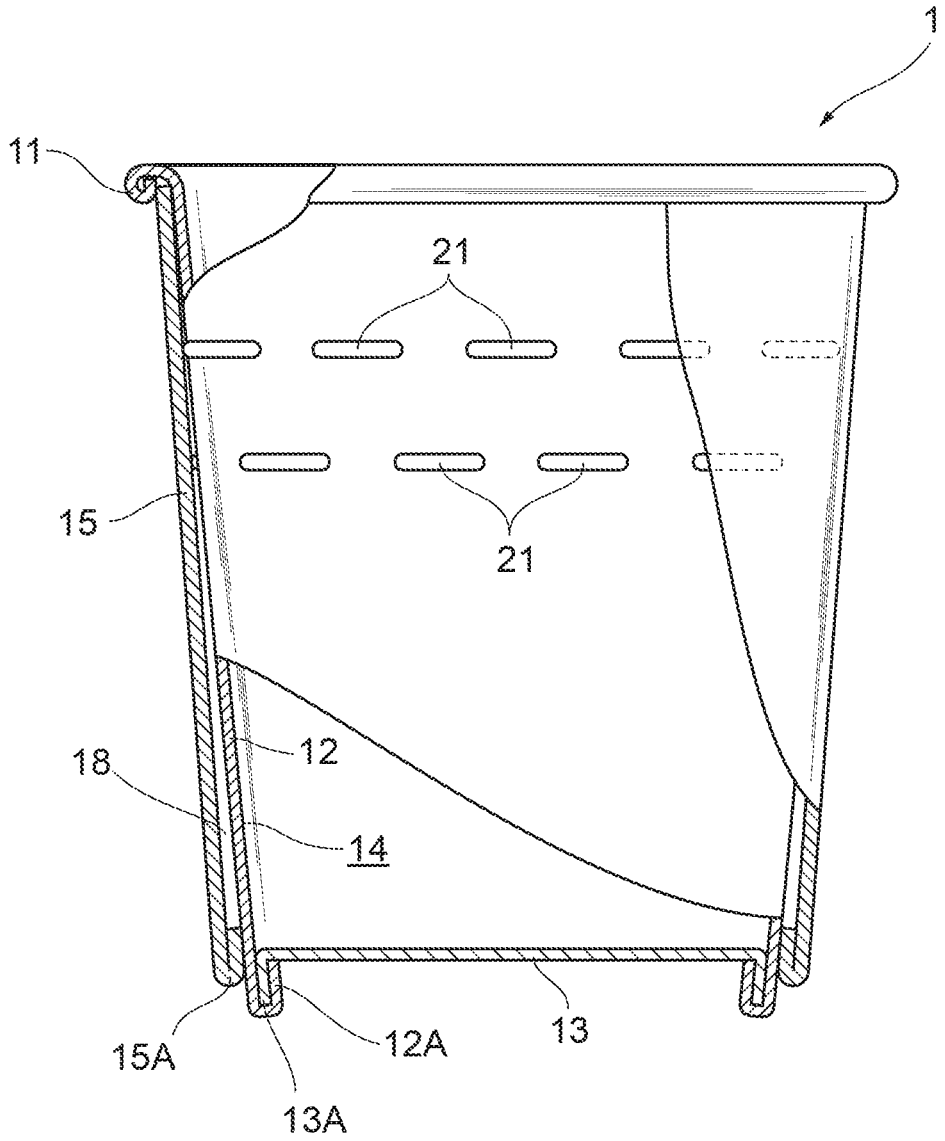
FIG. 2 is a partially cut-away sectional view of the double container according to the first embodiment.
Figure 3:
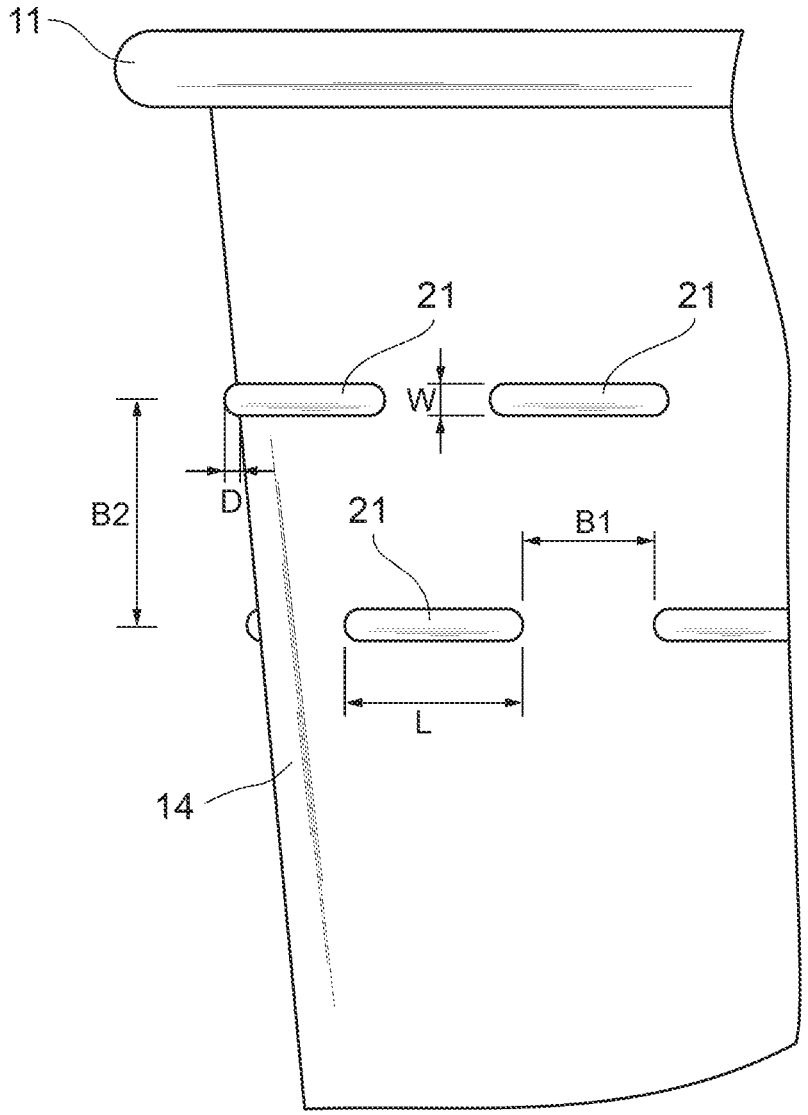
FIG. 3 illustrates an enlargement of a portion of an inner container constituting the double container according to the first embodiment.

FIG. 1 is an exploded perspective view of a double container according to a first embodiment, FIG. 2 a partially cut-away sectional view of the double container according to the first embodiment, and FIG. 3 an enlargement of a portion of a container body (inner container) constituting the double container according to the first embodiment.

A double container 1 is constituted by an inner container 14 and an exterior sleeve (outer cylinder) 15.

The inner container 14 is constituted by a barrel portion 12 and bottom portion 13. The barrel portion 12 of inner container 14 has the shape of a cylinder the diameter of which is large at the upper end but which diminishes as the lower end is approached. The circumferential edge portion of the upper end of the barrel portion 12, which is open at the top, is curled toward the outer side to form a so-called curled portion 11. The bottom portion 13 is circular and has its circumferential edge portion bent downwardly (bent portion 13A). The bottom portion 13 is fitted snugly into an opening in the lower face of the barrel portion 12 and the lower end portion of the barrel portion 12 is folded back toward its inner side (folded-back portion 12A). The folded-back portion 12A embraces the bent portion 13A. Both the inner and outer surfaces of the bent portion 13A of bottom portion 13 are bonded or solvent-welded to the inner surface of the folded-back portion 12A at the lower end of the barrel portion 12 which embraces the bent portion 13A. Used as the barrel portion 12 are, by way of example, a base paper, which serves as the base material, having a paper basis weight (density) of 240 g/m$^2$, and layers of polyethylene (PE) having a thickness of 15 μm, polyethylene terephthalate (PET) having a thickness of 12 μm, and polyethylene (PE) having a thickness of 40 μm built up on the inner surface of the base paper in the order mentioned. Used as the bottom portion 13 are, by way of example, a base paper, which serves as the base material, having a paper basis weight of 215 g/m$^2$, and layers of polyethylene (PE) having a thickness of 15 μm, polyethylene terephthalate (PET) having a thickness of 12 μm, and polyethylene (PE) having a thickness of 25 μm built up on the inner surface of the base paper in the order mentioned. The material, layer thickness and number of layers of each of the layers constituting the bottom portion 13 can be selected suitably in accordance with specifications.

The outer surface of the barrel portion 12 of inner container 14 is provided with two rows, one above the other, of a plurality of elongated projections (ribs) 21 (a row of elongated projections) arranged in a row and spaced apart in the circumferential direction of the barrel portion 12. The row of elongated projections is provided by coating the outer surface of the barrel portion 12 with a thermoplastic resin (hot melt) in elongated fashion and intermittently (non-continuously) over its entire circumference using a hot-melt applicator, with each elongated projection 21 having an elongated shape in the circumferential direction. With reference to FIG. 3, each elongated projection 21 is provided so as to have a length L of 5.0 to 20 mm in the circumferential direction (longitudinal direction), a width W of 1.0 to 2.0 mm in a direction perpendicular to the longitudinal direction, and a projection amount (height) D of 1.0 to 2.0 mm. Further, spacing B1 between mutually adjacent elongated projections 21 in the circumferential direction is made 5.0 to 15 mm, and spacing B2 between the two rows, one above the other, is made 25 mm or less.

The two rows of elongated projections 21 are provided one above the other at positions easily grasped when the double container 1 is held in one's hand, and both rows are situated on the double container 1 (inner container 14) at a location that is above half the height thereof. For example, the first row, which is the one near the open upper end, and the second row are provided at positions 24 mm and 40 mm, respectively, from the upper end of the double container 1.

The first row of the plurality of elongated projections 21 and the second row of the plurality of elongated projections 21 are arrayed in staggered fashion. That is, the plurality of elongated projections 21 of the first row and the plurality of elongated projections 21 of the second row are provided with their positions staggered in such a manner that they do not completely overlap (coincide) in the vertical direction.

In a manner similar to that of the barrel portion 12 of inner container 14, the exterior sleeve 15 has the shape of a cylinder the diameter of which is large at the upper end but which diminishes as the lower end is approached. The circumferential edge portion of the lower end of the exterior sleeve 15 is folded back onto its inner side to form a folded-back portion 15A. Instead of forming the folded-back portion 15A, a curled portion that is curled inward may be formed on the circumferential edge portion at the lower end of the exterior sleeve 15.

The inner container 14 is inserted (fitted) from its bottom portion 13 into the exterior sleeve 15. The circumferential edge portion of the upper end of the exterior sleeve 15 enters a gap on the inner side of the curled portion 11 of the circumferential edge portion at the upper end of the inner container 14 and the folded-back portion 15A of the circumferential edge portion at the lower end follows (contacts) the outer surface of the barrel portion 12 at the lower end thereof. The lower end portion (folded-back portion 15A) of the exterior sleeve 15 and the barrel portion 12 of the inner container 14 are fixed by an adhesive. In addition, the upper end portion of the exterior sleeve 15 and the curled portion 11 of the inner container 14 may be fixed by an adhesive. It may be so arranged that the circumferential edge portion at the lower end of the exterior sleeve 15 extends linearly, as is, rather than being folded back. In either case, the exterior sleeve 15 is provided on the outer side of the barrel portion 12 of inner container 14 and a gap (heat insulating space) 18 is formed between the outer surface of the barrel portion 12 and the inner surface of the exterior sleeve 15. It is possible to use coated cardboard having a paper basis weight of, say, 310 g/m$^2$ coated with an ultraviolet-curable varnish as the exterior sleeve 15.

Since the outer surface of the barrel portion 12 of inner container 14 is provided with the plurality of elongated projections 21, as described above, the plurality of elongated projections 21 support the exterior sleeve 15, which covers the barrel portion 12 of inner container 14 from the outer side, from the inner side, so to speak. With regard to the paper basis weight (310 g/m$^2$) of the coated cardboard constituting the exterior sleeve 15 and the paper basis weight (240 g/m$^2$) of the base paper constituting the barrel portion 12 of inner container 14, the barrel portion 12 of inner container 14 has the smaller paper basis weight, which means that the barrel portion 12 of inner container 14 is easier to deform than the exterior sleeve 15. When the double container 1 is grasped by one's hand, the inner container 14 is pressed inwardly via the elongated projections 21, whereupon the barrel portion 12 of inner container 14 yields inwardly before the exterior sleeve 15 does. When the double container 1 is grasped by one's hand, this portion of the exterior sleeve 15 will not readily come into contact with the barrel portion 12 of inner container 14. Even if hot water or hot coffee or like is poured into the double container 1, therefore, it will be difficult for the heat of the inner container 14 to be transferred to the exterior sleeve 15. Thus the hand holding the double container avoids feeling heat.

Further, rather than the elongated projections 21 being made continuous in the circumferential direction, a plurality of the elongated projections 21 are provided in line and spaced apart circumferentially. Therefore, since a closed space is not formed by the elongated projections 21, it is difficult for the heat of the inner container 14 to remain confined to the thermal insulating space 18. In the case where, instead of forming the folded-back portion 15A, a curled portion that is curled inward is formed on the circumferential edge portion at the lower end of the exterior sleeve 15, as mentioned above, the curled portion may be formed beforehand to have a penetrating hole (a ventilation hole) as by a cut, notch or hole or the like. The heat in the thermal insulating space 18 can escape through the penetrating hole and, as a result, further improve the heat insulating effectiveness of the double container 1.

The dimensions of the above-mentioned elongated projections 21 and the spacing B1 (FIG. 3) between the plurality of elongated projections 21 arranged in a row circumferentially are defined taking into consideration such factors as the size of the human hand and fingers and the amount of flexure of the exterior sleeve 15. By adopting 5.0 to 15 mm as the spacing BI between mutually adjacent elongated projections 21 in the circumferential direction, even if a point exactly midway between two elongated projections 21 is pressed, the exterior sleeve 15 is capable of being supported by the elongated projections 21 on both sides, thereby making it difficult for the exterior sleeve 15 to come into direct contact with the barrel portion 12.

The reason for providing two rows of the elongated projections 21, one above the other, is to facilitate grasping (pressing) of the location where the elongated projections 21 have been provided, both in a case where a man having comparative large hands holds the double container 1 and in a case where a woman having comparatively small hands holds the double container 1. By adopting 25 mm or less as the spacing B2 between the rows, even if a point exactly' midway between the two rows is pressed, the exterior sleeve 15 is capable of being supported by the elongated projections 21 located above and below. Naturally, it goes without saying that more rows, say, for example, three or four rows, of the elongated projections 21 may be provided. Further, just one row of the elongated projections 21 can be provided. For example, it can be arranged so that, if the double container 1 has a comparatively small capacity and, hence, is of small dimensions, one row of the elongated projections 21 is provided, with the number of rows of the elongated projections being increased with an increase in the capacity of the double container 1. Furthermore, by providing the plurality of elongated projections 21 of the first row and the plurality of elongated projections 21 of the second row with their positions staggered in such a manner that they do not completely overlap in vertical direction, the exterior sleeve 15 can be supported in good balance by the plurality of elongated projections 21.

Figure 4:
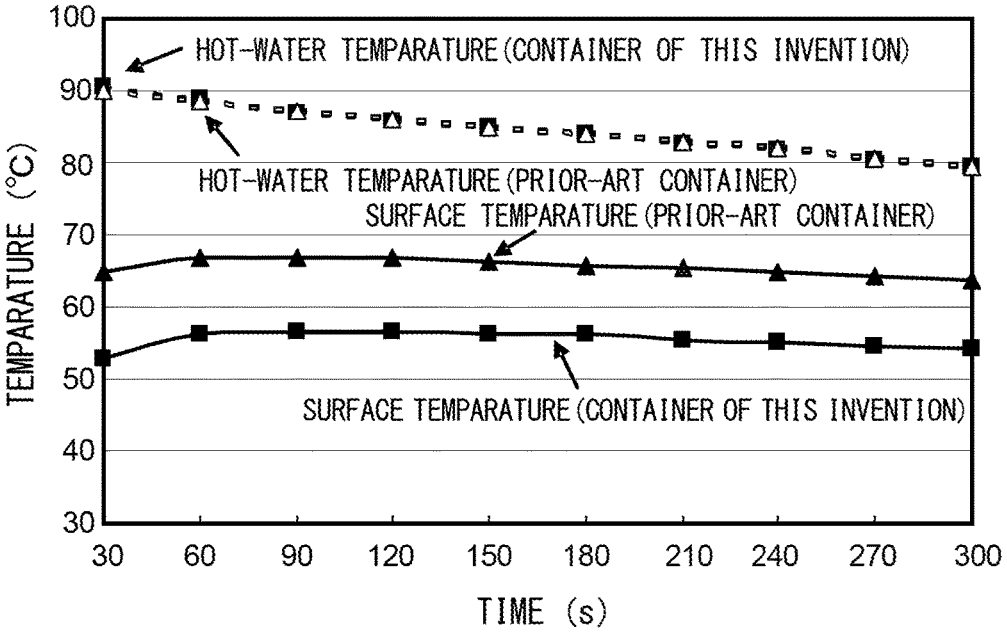
FIG. 4 is a graph illustrating test results from measurement of thermal insulation.

Table 1 illustrates test results from measurement of thermal insulation. FIG. 4 is a graph illustrating test results from measurement of thermal insulation shown in Table 1 The horizontal axis is a plot of time (in seconds) and the vertical axis is a plot of temperature (° C.). The test results shown in Table 1 are plotted and plotted points are connected by curves.

TABLE 1

| ELAPSED TIME | CONTAINER OF THIS INVENTION | | PRIOR-ART CONTAINER | |
|---|---|---|---|---|
| FOLLOWING POURING (sec) | HOT-WATER TEMPERATURE (° C.) | SURFACE TEMPERATURE (° C.) | HOT-WATER TEMPERATURE (° C.) | SURFACE TEMPERATURE (° C.) |
| 30 | 90.5 | 52.9 | 90.0 | 65.0 |
| 60 | 88.8 | 56.2 | 88.7 | 66.8 |
| 90 | 87.0 | 56.6 | 87.2 | 66.9 |
| 120 | 85.8 | 56.5 | 86.0 | 66.8 |
| 150 | 85.0 | 56.3 | 84.9 | 66.4 |
| 180 | 84.0 | 56.2 | 84.0 | 65.8 |
| 210 | 82.7 | 55.4 | 82.8 | 65.4 |
| 240 | 81.6 | 55.1 | 81.9 | 65.0 |
| 270 | 80.2 | 54.6 | 80.7 | 64.3 |
| 300 | 79.4 | 54.3 | 79.3 | 63.6 |

In the test for measuring thermal insulation, the double container 1 (container of this invention) equipped with the elongated projections 21 and a double container (prior-art container) having the same dimensions but not equipped with the elongated projections 21 were compared. Hot water at 90° C. was poured into the containers up to a position 15 mm from the upper end thereof, and a thermocouple-type temperature sensor having a diameter of 8 mm was brought into contact with a position 73 mm from the lower end (a height equivalent to two-thirds of the overall container height) thereof under a pressure of $1.9\times10^4$ N/m$^2$. Taking into consideration the speed of response of the temperature sensor, measurement of surface temperature of the exterior sleeve 15 was started 30 seconds after the pouring of the hot water, and the measured temperature was recorded every 30 seconds. Further, the temperature (hot-water temperature) of the hot water at the time of measurement of the surface temperature of the exterior sleeve 15 was measured as well. The magnitude of the contact pressure ($1.9\times10^4$ N/m$^2$) applied to the temperature sensor was assumed to be the force that would be applied by a human hand when holding the container.

It will be appreciated from Table 1 and FIG. 4 that, in comparison with the prior-art container, the double container 1 (the container of this invention) having the elongated projections 21 exhibits a surface temperature for the exterior sleeve 15 that is fairly low, and that the temperature difference ranges from 10.1 to 10.6° C. over an elapsed time of 60 to 150 seconds during which temperature was comparatively stable. The reason is considered to be that, owing to the elongated projections 21, the exterior sleeve 15 does not contact the barrel portion 12 of the inner container 14 directly, whereby the thermal insulating space 18 is assured.

In the first embodiment described above, the outer surface of the barrel portion 12 of inner container 14 is provided with the elongated projections 21. However, the elongated projections 21 may just as well be provided on the inner surface of the exterior sleeve 15 instead of the outer surface of the barrel portion 12 of inner container 14. Naturally, the elongated projections 21 can be provided on both the outer surface of the barrel portion 12 of inner container 14 and the inner surface of the exterior sleeve 15. In a case where the elongated projections 21 are provided on both the outer surface of the barrel portion 12 of inner container 14 and the inner surface of the exterior sleeve 15, the plurality of elongated projections 21 of the first row would be provided on the outer surface of the barrel portion 12 of inner container 14 and the plurality of elongated projections 21 of the second row would be provided on the inner surface of the exterior sleeve 15, by way of example.

Figure 5:
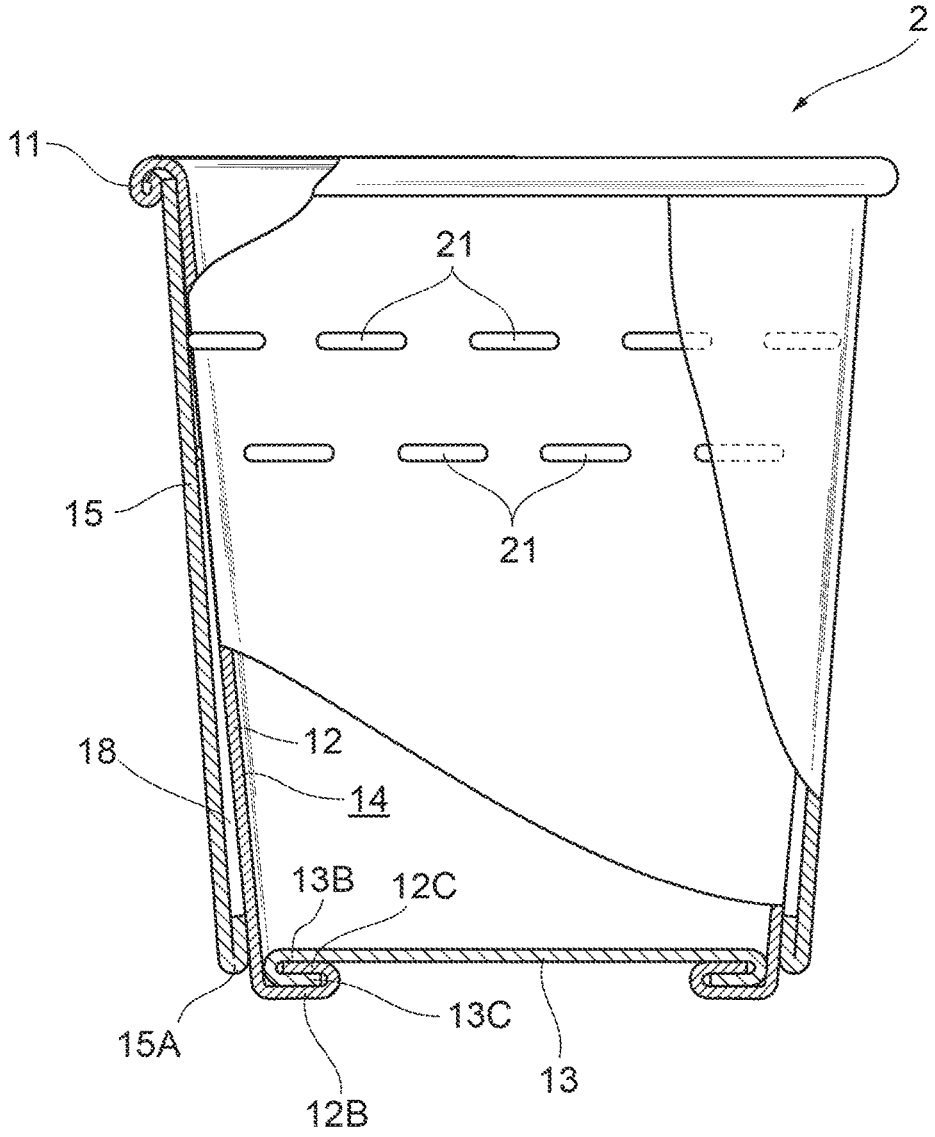
FIG. 5 is a partially cut-away sectional view of a double container according to a second embodiment.

FIG. 5 is a partially cut-away sectional view of a double container according to a second embodiment. This double container differs from the double container 1 (see FIG. 2) of the above-described first embodiment in that the lower end portion of the barrel portion 12 of inner container 14 is bent inwardly and is joined to the circumferential edge portion of the bottom portion 13 so as to cover the outer surface thereof.

The lower end portion of the barrel portion 12 of the inner container 14 constituting a double container 2 is bent substantially at right angles to the inner side (inward, in a direction toward the portion of the inner container 14 where contents are received) (the bent portion is indicated at reference characters 12B), and the tip of the bent portion 12B is folded back on its inner side (the folded-back portion is indicated at reference characters 12C). A circumferential edge portion 13B of the bottom portion 13 is folded back on its outer side (the folded-back portion is indicated at reference characters 13C). The folded-back portion 13C is sandwiched between the bent portion 12B and the bent portion 12C of the barrel portion 12. These embraced portions 13B, 12C, 13C, 12B are joined (bonded, solvent-welded) (fixed) together at least partially and preferably entirely.

In a case where a paper cup in which contents have been received is heated and cooked in an electronic range, there are instances where charring occurs at a so-called lower rim, which is formed by elongation of the lower end of the barrel portion of the paper cup. Charring readily occurs particularly at joined portions where there is paper overlap. At the portion that is in contact with the contents, however, charring does not readily occur because the heat is dissipated by the contents. The above-described double container 2 does not have a lower rim. Accordingly, charring will not occur when the double container 2 containing contents is heated and cooked in an electronic range.

Figure 6:
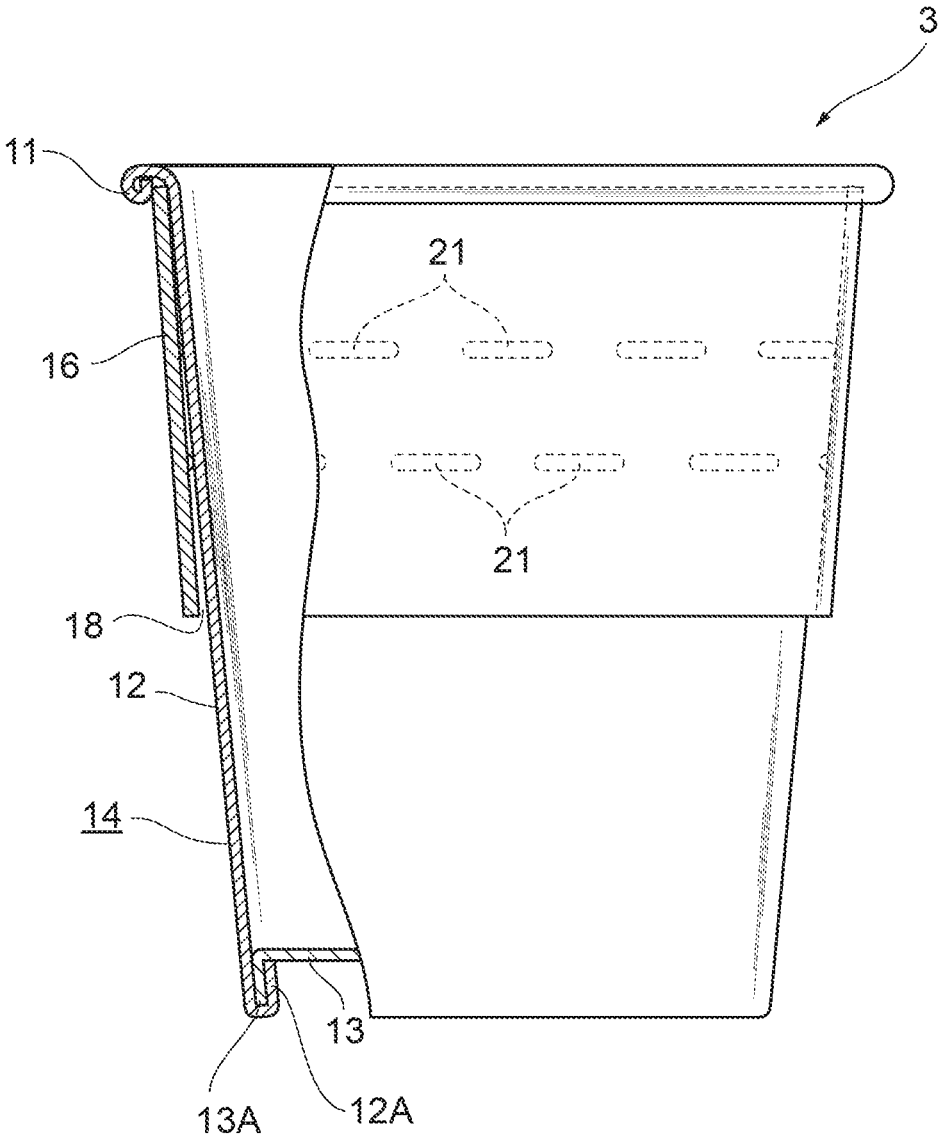
FIG. 6 is a partially cut-away sectional view of a double container according to a third embodiment.

FIG. 6 is a partially cut-away sectional view of a double container according to a third embodiment.

A double container 3 is constituted by the inner container 14 and an exterior sleeve (outer cylinder) 16. Members identical with those of the double container of the first embodiment described above are designated by like reference characters and need not be described again in detail.

In a manner similar to that of the barrel portion 12 of inner container 14, the exterior sleeve 16 has the shape of a cylinder the diameter of which is large at the upper end but which diminishes as the lower end is approached. Both of the circumferential edge of the upper end and the circumferential edge of the lower end extend linearly.

The external sleeve 16 has a height that is 40 to 65% that of the inner container 14. The inner container 14 is inserted (fitted) from its bottom portion 13 into the exterior sleeve 16. The circumferential edge portion of the upper end of the exterior sleeve 16 enters a gap on the inner side of the curled portion 11 of the circumferential edge portion at the upper end of the inner container 14. Here the insertion of inner container 14 stops. When the exterior sleeve 16 is grasped and lifted by one's hand, the inner container 14 can be lifted along with it. That is, the entirety of the double container 3 can be lifted. The exterior sleeve 16 is provided on the outer side of the barrel portion 12 of inner container 14 in an area that is approximately the upper half of the barrel portion 12, and the gap (heat insulating space) 18 is formed between the outer surface of the upper half of the barrel portion 12 and the inner surface of the exterior sleeve 16. It is possible to use coated cardboard having a paper basis weight of, say, 310 $g/m^2$ coated with an ultraviolet-curable varnish as the exterior sleeve 16.

The inner surface of the exterior sleeve 16 is provided with two rows, one above the other, of a plurality of elongated projections 21 (a row of elongated projections) arranged in a row and spaced apart in the circumferential direction of the exterior sleeve 16.

Figure 7:
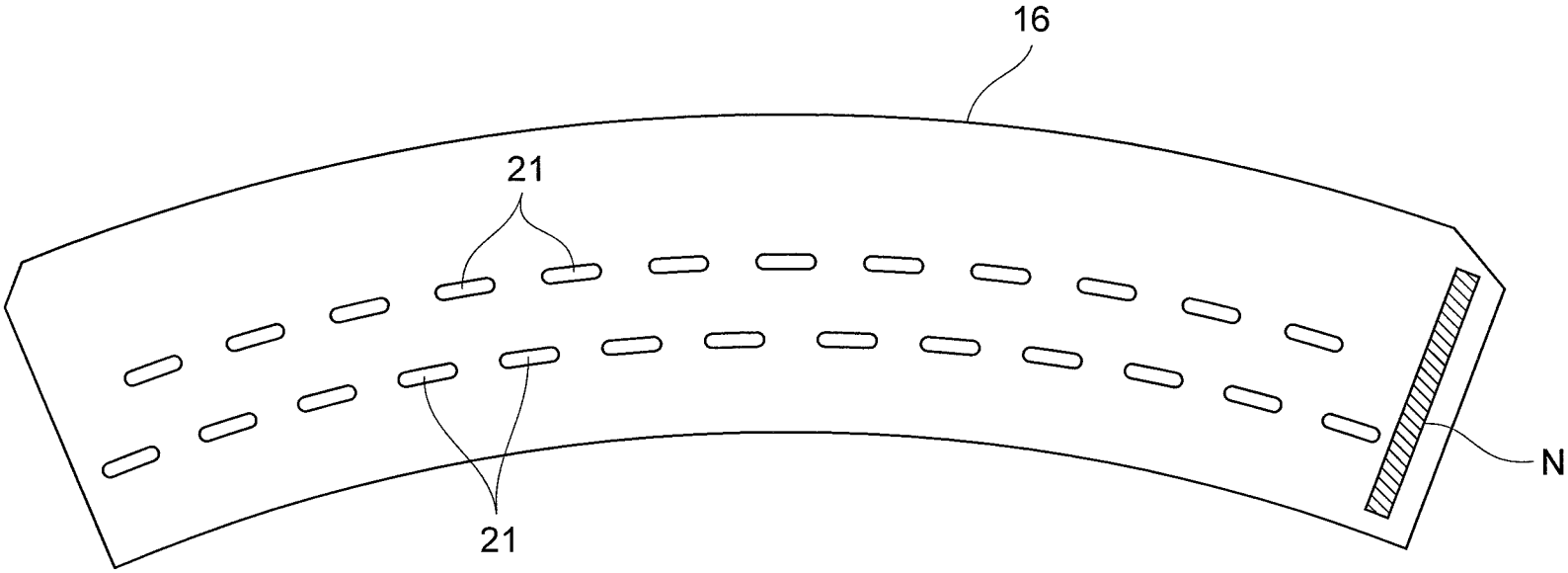
FIG. 7 is a developed view of an exterior sleeve constituting the double container according to the third embodiment.
Figure 8:
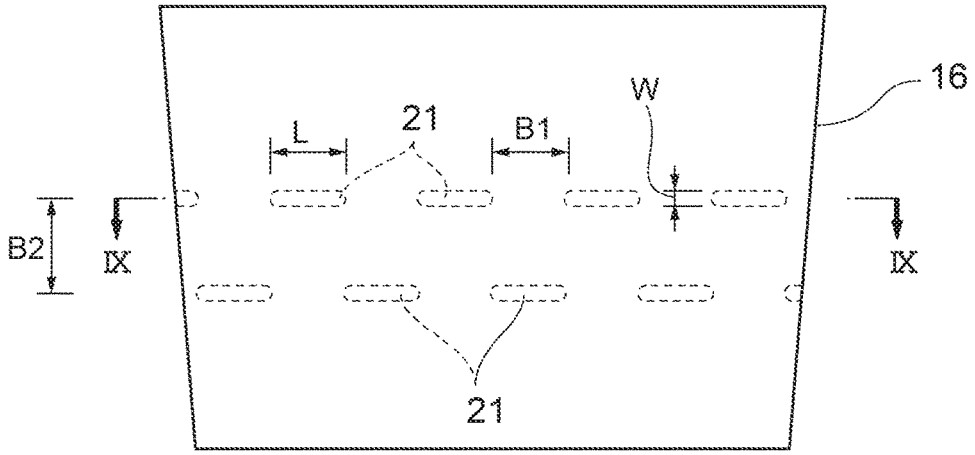
FIG. 8 is a front view of the exterior sleeve constituting the double container according to the third embodiment.
Figure 9:
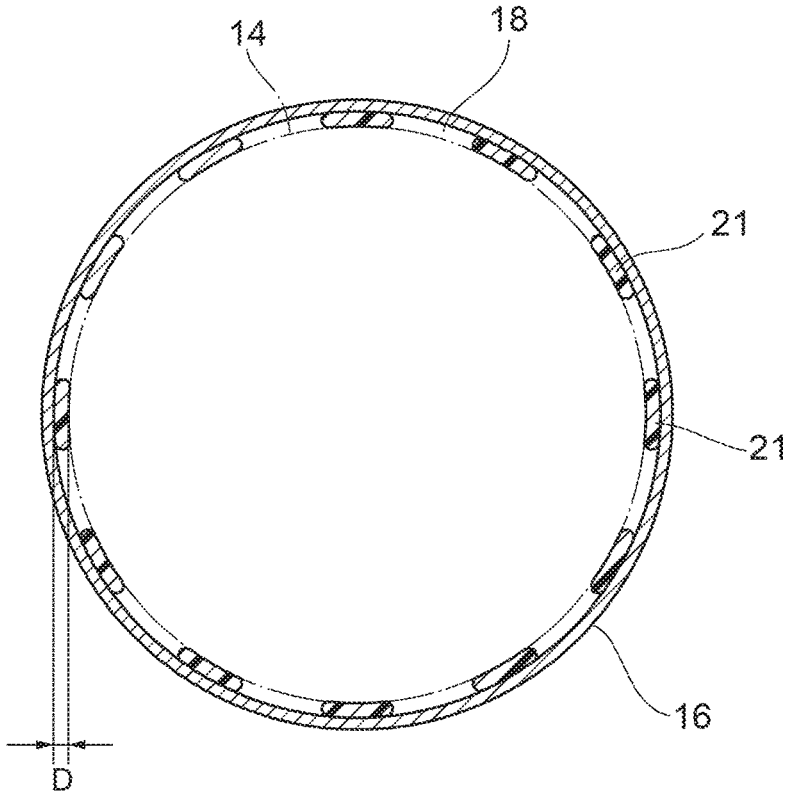
FIG. 9 is an end view taken along line IX-IX of FIG. 8.

FIG. 7 is a developed view (blank view) of the exterior sleeve 16 and shows the surface that will form the inner surface of the exterior sleeve 16. FIG. 8 is a front view of the exterior sleeve formed into the shape of a cylinder, and FIG. 9 is an end view taken along line IX-IX of FIG. 8. The amount of projection (height D) of the elongated projections 21 is rendered in somewhat exaggerated form in FIG. 9.

The exterior sleeve 16 is formed into a cylindrical shape by pasting together the side edge portions of a blank (FIG. 7) that has been formed into an arcuate shape. An adhesive portion N used in pasting the side edges together is indicated by hatching in FIG. 7.

The row of elongated projections is provided by coating the inner surface of the exterior sleeve 16 with a thermoplastic resin (hot melt) in elongated fashion and intermittently (non-continuously) over its entire circumference using a hot-melt applicator, with each elongated projection 21 having an elongated shape in the circumferential direction. With reference to FIGS. 8 and 9, each elongated projection 21 is provided so as to have a length L of 5.0 to 20 mm in the circumferential direction (longitudinal direction), a width W of 1.0 to 2.0 mm in a direction perpendicular to the longitudinal direction, and a projection amount (height) D of 1.0 to 2.0 mm. Further, spacing B1 between mutually adjacent elongated projections 21 in the circumferential direction is made 5.0 to 15 mm, and spacing B2 between the two rows, one above the other, is made 25 mm or less.

The two rows of elongated projections 21 are provided one above the other at positions easily grasped when the double container 1 is held in one's hand. For example, when the double container is assumed to be the double container 3, the first row, which is the one near the upper end, and the second row are provided at positions 26 mm and 43 mm, respectively, from the open upper end of the double container 3 (inner container 14).

The first row of the plurality of elongated projections 21 and the second row of the plurality of elongated projections 21 are arrayed in staggered fashion. That is, the plurality of elongated projections 21 of the first row and the plurality of elongated projections 21 of the second row are provided with their positions staggered in such a manner that they do not completely overlap (coincide) in the vertical direction.

Since the inner surface of the exterior sleeve 16 is provided with the plurality of elongated projections 21, as described above, the plurality of elongated projections 21 support the exterior sleeve 16, which covers the barrel portion 12 of inner container 14 from the outer side, from the inner side, so to speak. With regard to the paper basis weight (310 g/m$^2$) of the coated cardboard constituting the exterior sleeve 16 and the paper basis weight (280 g/m$^2$) of the base paper constituting the barrel portion 12 of inner container 14, the barrel portion 12 of inner container 14 has the smaller paper basis weight, which means that the barrel portion 12 of inner container 14 is easier to deform than the exterior sleeve 16. When the double container 3 is grasped by one's hand, the inner container 14 is pressed inwardly via the elongated projections 21, whereupon the barrel portion 12 of inner container 14 yields inwardly before the exterior sleeve 16 does. When the double container 3 (exterior sleeve 16) is grasped by one's hand, this portion of the exterior sleeve 16 will not readily come into contact with the barrel portion 12 of inner container 14. Even if hot water or hot coffee or the like is poured into the double container 3, therefore, it will be difficult for the heat of the inner container 14 to be transferred to the exterior sleeve 16. Thus the hand holding the double container 3 avoids feeling heat.

Further, rather than the elongated projections 21 being made continuous in the circumferential direction, a plurality of the elongated projections 21 are provided in line and spaced apart circumferentially. Therefore, since a closed space is not formed by the elongated projections 21, it is difficult for the heat of the inner container 14 to remain confined to the thermal insulating space 18.

The dimensions of the above-mentioned elongated projections 21 and the spacing B1 (FIG. 3) between the plurality of elongated projections 21 arranged in a row circumferentially are defined taking into consideration such factors as the size of the human hand and fingers and the amount of flexure of the exterior sleeve 16. By adopting 5.0 to 15 mm as the spacing B1 between mutually adjacent elongated projections 21 in the circumferential direction, even if a point exactly midway between two elongated projections 21 is pressed, the exterior sleeve 16 is capable of being supported by the elongated projections 21 on both sides, thereby making difficult for the exterior sleeve 16 to come into direct contact with the barrel portion 12.

The reason for providing two rows of the elongated projections 21, one above the other, is to facilitate grasping (pressing) of the location where the elongated projections 21 have been provided, both in a case where a man having comparative large hands holds the double container 3 and in a case where a woman having comparatively small hands holds the double container 3. By adopting 25 mm or less as the spacing B2 between the rows, even if a point exactly midway between the two rows is pressed, the exterior sleeve 16 is capable of being supported by the elongated projections 21 located above and below. Naturally, it goes without saying that more rows, say, for example, three or four rows, of the elongated projections 21 may be provided. Further, just one row of the elongated projections 21 can be provided. For example, it can be arranged so that, if the double container 3 has a comparatively small capacity and, hence, is of small dimensions, one row of the elongated projections 21 is provided, with the number of rows of the elongated projections being increased with an increase in the capacity of the double container 3. Furthermore, by providing the plurality of elongated projections 21 of the first row and the plurality of elongated projections 21 of the second row with their positions staggered in such a manner that they do not completely overlap in the vertical direction, the exterior sleeve 16 can be supported in good balance by the plurality of elongated projections 21.

The exterior sleeve 16 is not fixed to the inner container 14 and is capable of being attached and detached. Accordingly, the exterior sleeve 16 can be reused any number of times. Further, when hot water or a hot beverage such as hot coffee is poured, the exterior sleeve 16 is fitted on to obtain the double container 3. When water or a cold beverage such as juice is poured, the inner container 14 can be used alone without fitting on the exterior sleeve 16.

Naturally, the exterior sleeve 16 can also be fixed to the inner container 14. In this case the circumferential edge portion at the upper end of the exterior sleeve 16 and the curled portion 11 of the inner container 14 would be bonded together as by an adhesive or the like.

Since the exterior sleeve 16 constituting the double container 3 is provided in an area covering approximately the upper half of the inner container 14, resources are conserved in comparison with the double container 1 (see FIGS. 1 and 2) having the exterior sleeve 15 the height of which extends substantially over the full height of the inner container 14. In addition, overall height can be reduced when a plurality of the double containers 3 are stacked. Overall height when ten of the double containers 3 having the exterior sleeve 16 were stacked and overall height when ten of the double containers 1 having the exterior sleeve 15 the height of which extends substantially over the full height of the inner container 14 were stacked were compared. The result was that the double container 3 having the exterior sleeve 16 could lower height by 11 mm. Thus, the double container 3 exhibits excellent stackability.

Figure 10:
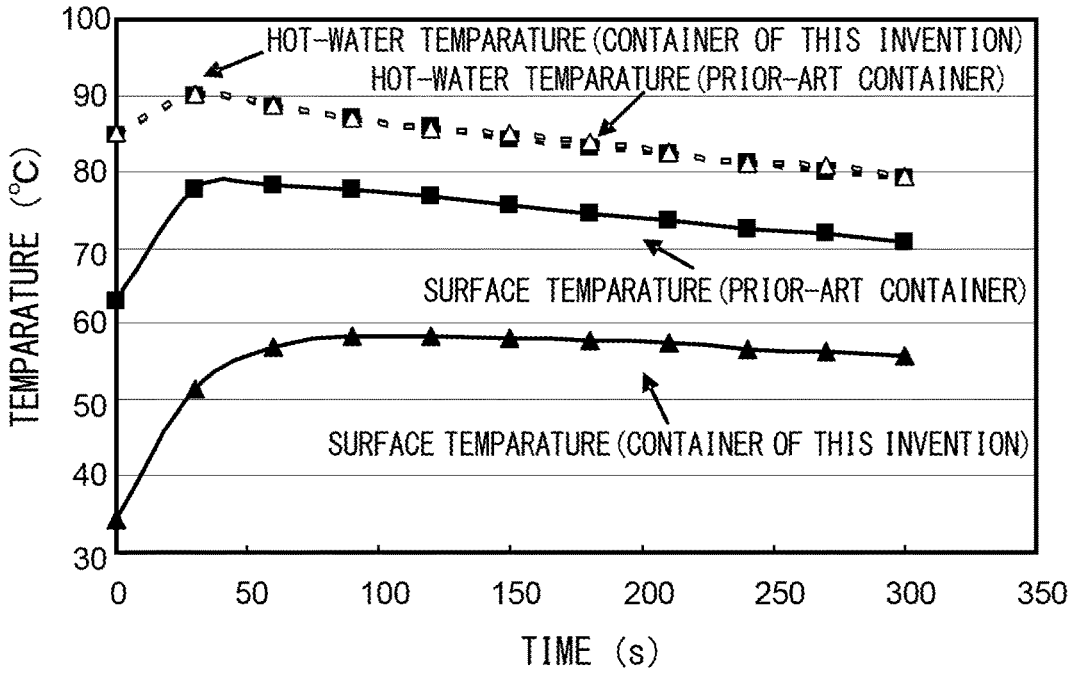
FIG. 10 is a graph illustrating test results from measurement of thermal insulation.

Table 2 illustrates test results from measurement of thermal insulation. FIG. 10 is a graph illustrating test results from measurement of thermal insulation shown in Table 2. The horizontal axis is a plot of time (in seconds) and the vertical axis is a plot of temperature (° C.). The test results shown in Table 2 are plotted and plotted points are connected by curves.

TABLE 2

| ELAPSED TIME | CONTAINER OF THIS INVENTION | | PRIOR-ART CONTAINER | |
|---|---|---|---|---|
| FOLLOWING POURING (sec) | HOT-WATER TEMPERATURE (° C.) | SURFACE TEMPERATURE (° C.) | HOT-WATER TEMPERATURE (° C.) | SURFACE TEMPERATURE (° C.) |
| 0 | 85.0 | 34.3 | 84.7 | 62.9 |
| 30 | 90.2 | 51.6 | 90.0 | 77.7 |
| 60 | 88.8 | 57.0 | 88.4 | 78.2 |
| 90 | 87.2 | 58.5 | 87.2 | 77.6 |

TABLE 2-continued

| ELAPSED TIME | CONTAINER OF THIS INVENTION | | PRIOR-ART CONTAINER | |
|---|---|---|---|---|
| FOLLOWING POURING (sec) | HOT-WATER TEMPERATURE (° C.) | SURFACE TEMPERATURE (° C.) | HOT-WATER TEMPERATURE (° C.) | SURFACE TEMPERATURE (° C.) |
| 120 | 85.7 | 58.4 | 85.9 | 76.7 |
| 150 | 85.0 | 58.1 | 84.2 | 75.5 |
| 180 | 83.9 | 57.8 | 83.2 | 74.4 |
| 210 | 82.5 | 57.4 | 82.2 | 73.5 |
| 240 | 81.2 | 56.7 | 81.0 | 72.6 |
| 270 | 80.7 | 56.4 | 80.0 | 71.8 |
| 300 | 79.4 | 55.8 | 79.0 | 70.8 |

In the test for measuring thermal insulation, the double container 3 (container of this invention) equipped with the exterior sleeve 16 having the elongated projections 21 and a container (prior-art container) not having the an exterior sleeve were compared. The exterior sleeve 16 having a height of 60 mm was fitted onto the inner container 14 having a height of 110 mm. Hot water at 90° C. was poured into the containers up to a position 15 mm from the upper end thereof, and a thermocouple-type temperature sensor having a diameter of 8 mm was brought into contact with a position 73 mm from the lower end (a height equivalent to two-thirds of the overall container height) thereof under a pressure of $1.9\times10^4$ N/m$^2$. Surface temperature was recorded every 30 seconds. Further, the temperature (hot-water temperature) of the hot water at the time of measurement of surface temperature was measured as well. The magnitude of the contact pressure ($1.9\times10^4$ N/m$^2$) applied to the temperature sensor was assumed to be the force that would be applied by a human hand when holding the container.

It will be appreciated from Table 2 and FIG. 10 that, in comparison with the prior-art container, the double container 3 (the container of this invention) equipped with the exterior sleeve 16 having the elongated projections 21 exhibits a surface temperature that is fairly low, and that the temperature difference ranges from 17.4 to 21.2° C. over an elapsed time of 60 to 150 seconds during which temperature was comparatively stable. The reason is considered to be that, owing to the elongated projections 21, the exterior sleeve 15 does not contact the barrel portion 12 of the inner container 14 directly, whereby the thermal insulating space 18 is assured.

In the foregoing embodiment described above, the inner surface of the exterior sleeve 16 is provided with the elongated projections 21. However, the elongated projections 21 may just as well be provided on the outer surface of the barrel portion 12 of inner container 14 instead of the inner surface of the exterior sleeve 16. Naturally, the elongated projections 21 can be provided on both the inner surface of the exterior sleeve 16 and the outer surface of the barrel portion 12 of inner container 14. in a case where the elongated projections 21 are provided on both the inner surface of the exterior sleeve 16 and the outer surface of the barrel portion 12 of inner container 14, the plurality of elongated projections 21 of the first row would be provided on the inner surface of the exterior sleeve 16 and the plurality of elongated projections 21 of the second row would be provided on the outer surface of the barrel portion 12 of inner container 14, by way of example.

Figure 11:
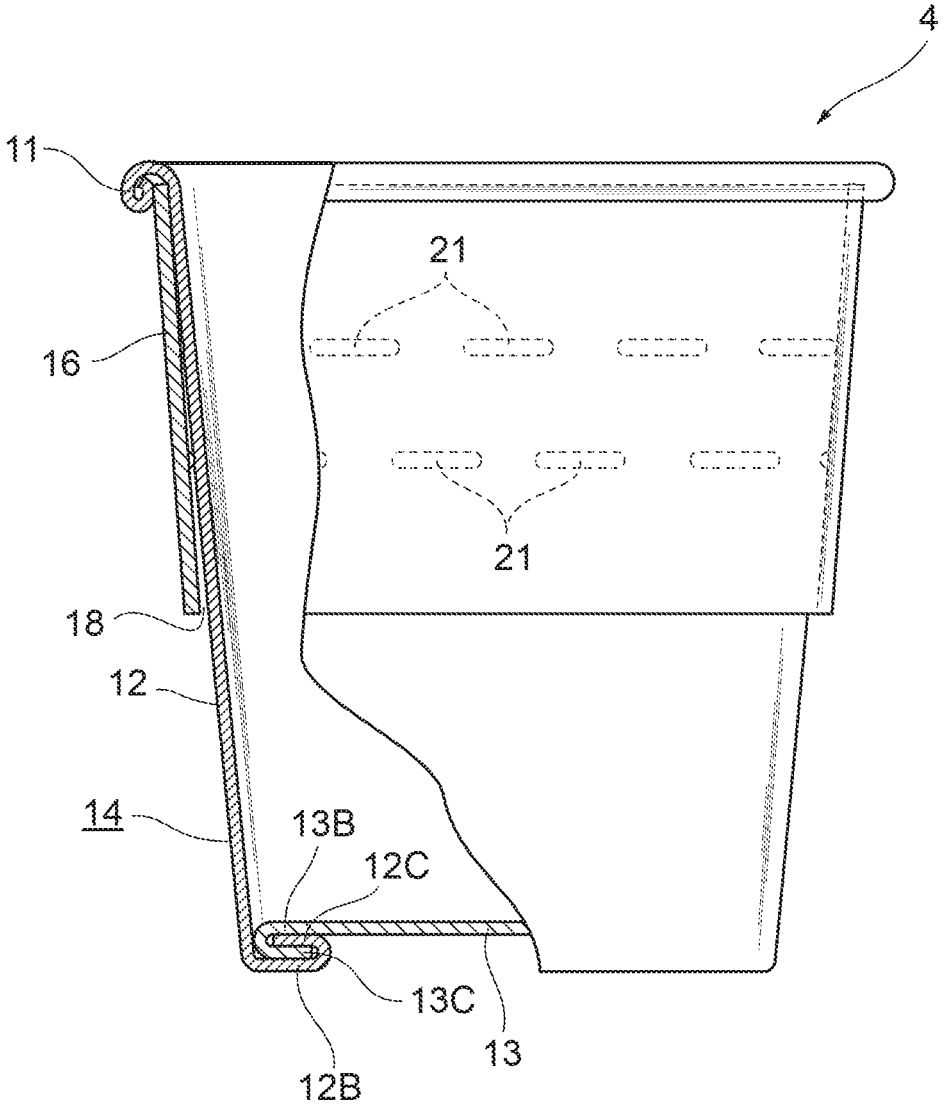
FIG. 11 is a partially cut-away sectional view of a double container according to a fourth embodiment.

FIG. 11 is a partially cut-away sectional view of a double container according to a fourth embodiment. This double container differs from the double container 3 (see FIG. 6) of the above-described third embodiment in that the lower end portion of the barrel portion 12 of inner container 14 is bent inwardly and is joined to the circumferential edge portion of the bottom portion 13 so as to cover the outer surface thereof. Members identical with those of the double container 2 shown in FIG. 5 are designated by like reference characters and need not be described again in detail.

The double container 4 of the fourth embodiment does not have a lower rim. Accordingly, in a manner similar to that of the double container 2 (see FIG. 5) of the second embodiment described above, charring will not occur when the double container 4 containing contents is heated and cooked in an electronic range.

DESCRIPTION OF SYMBOLS

1, 2, 3, 4 . . . DOUBLE CONTAINER
12 . . . BARREL PORTION
13 . . . BOTTOM PORTION
14 . . . INNER CONTAINER
15, 16 . . . EXTERIOR SLEEVE
18 . . . THERMAL INSULATING SPACE
21 . . . ELONGATED PROJECTION

The invention claimed is:

1. A double container comprising:

a paper inner container having a cylindrical barrel portion formed to have a curled portion on an upper circumferential edge thereof, and a bottom portion provided on a lower end of the barrel portion so as to close a lower face thereof; and a paper exterior sleeve which covers the barrel portion so as to form a thermal insulating space between itself and an outer surface of the barrel portion;

wherein the circumferential edge portion of the upper end portion of the exterior sleeve enters a gap on the inner side of the curled portion of the circumferential edge portion at the upper end of the inner container, and the thermal insulating space between the exterior sleeve and the inner container expands as the lower end is approached; and wherein at least one of the outer surface of the barrel portion of the inner container and an inner surface of the exterior sleeve is provided over the entire circumference thereof with a plurality of elongated projections, which consist of thermoplastic resin, arranged in a row and spaced apart in a circumferential direction, and the projections extend in an elongated fashion circumferentially and each has a projection amount of 1.0 to 2.0 mm, and the row of the plurality of elongated projections is situated at a location that is above half of the height of the double container.

2. A double container according to claim 1, wherein the exterior sleeve covers substantially the entirety of the barrel portion of the inner container and is secured to the barrel portion.

3. A double container according to claim 1, wherein the exterior sleeve has a height that is smaller than that of the inner container, and the exterior sleeve extends partway from the curled portion of the inner container toward the lower end of the inner container; and wherein the plurality of elongated projections are provided on at least one of the outer surface of the barrel portion of the inner container and the inner surface of the exterior sleeve in an area covered by the exterior sleeve.

4. A double container according to claim 3, wherein the exterior sleeve has a height that is 40 to 65% of that of the inner container.

5. A double container according to claim 3, wherein the exterior sleeve is freely attached to and detached from the inner container.

6. A double container according to claim 3, wherein the exterior sleeve is secured to the inner container.

7. A double container according to claim 1, wherein the barrel portion has a paper basis weight that is smaller than that of the exterior sleeve.

8. A double container according to claim 1, wherein the row of the plurality of elongated projections arranged in a row and spaced apart in the circumferential direction is situated on the double container at a location that is above half of the height thereof.

9. A double container according to claim 1, wherein spacing between mutually adjacent elongated projections in the circumferential direction is 5.0 to 15 mm.

10. A double container according to claim 1, wherein each elongated projection has a length of 5.0 to 20 mm in a longitudinal direction and a width, in a direction that is perpendicular to the longitudinal direction, of 1.0 to 2.0 mm.

11. A double container according to claim 1, wherein multiple rows of the plurality of elongated projections, arranged in a row and spaced apart in the circumferential direction, are provided in a spaced-apart relation in a vertical direction.

12. A double container according to claim 11, wherein the pluralities of elongated projections included in respective ones of the spaced-apart mutually adjacent rows of elongated projections are provided at positions that are staggered in such a manner that they do not completely overlap each other in the vertical direction.

13. A double container according to claim 11, wherein spacing between the rows of elongated projections is 25 mm or less.

14. An external sleeve covering a barrel portion of a paper inner container having a cylindrical barrel portion formed to have a curled portion on an upper circumferential edge thereof, and a bottom portion provided on a lower end of the barrel portion so as to close a lower face thereof, the exterior sleeve forming a thermal insulating space between itself and an outer surface of the barrel portion;

wherein the circumferential edge portion of the upper end portion of the exterior sleeve enters a gap on the inner side of the curled portion of the circumferential edge portion at the upper end of the inner container, and the thermal insulating space between the exterior sleeve and the inner container expands as the lower end is approached;

wherein the exterior sleeve has a height that is smaller than that of the inner container and covers the inner container over an area extending partway from the curled portion of the inner container toward a lower edge of the inner container; and wherein the inner surface of the exterior sleeve is provided over the entire circumference thereof with a plurality of elongated projections, which consist of thermoplastic resin, arranged in a row and spaced apart in a circumferential direction, and the projections extend in an elongated fashion circumferentially and each has a projection amount of 1.0 to 2.0 mm, and the row of the plurality of elongated projections is situated at a location that is above half of the height of the inner container.

15. The exterior sleeve according to claim 14, wherein spacing between mutually adjacent elongated projections in the circumferential direction is 5.0 to 15 mm.

16. The exterior sleeve according to claim 14, wherein each elongated projection has a length of 5.0 to 20 mm in a longitudinal direction and a width, in a direction perpendicular to the longitudinal direction, of 1.0 to 2.0 mm.

17. The exterior sleeve according to claim 14, wherein multiple rows of the plurality of elongated projections, arranged in a row and spaced apart in the circumferential direction, are provided in a spaced-apart relation in a vertical direction.

18. The exterior sleeve according to claim 17, wherein the pluralities of elongated projections included in respective ones of the spaced-apart mutually adjacent rows of elongated projections are provided at positions that are staggered in such a manner that they do not completely overlap each other in the vertical direction.

19. The exterior sleeve according to claim 17, wherein spacing between rows of elongated projections is 25 mm or less.

* * * * *